US011772257B1

(12) United States Patent
St.Pierre

(10) Patent No.: US 11,772,257 B1
(45) Date of Patent: Oct. 3, 2023

(54) REPLACABLE AXE HEAD SYSTEM AND METHOD

(71) Applicant: Pete St.Pierre, Edmonton (CA)

(72) Inventor: Pete St.Pierre, Edmonton (CA)

( * ) Notice: Subject to any disclaimer, the term of this patent is extended or adjusted under 35 U.S.C. 154(b) by 0 days.

(21) Appl. No.: 18/110,194

(22) Filed: Feb. 15, 2023

(51) Int. Cl.
*B25G 3/26* (2006.01)
*B26B 23/00* (2006.01)

(52) U.S. Cl.
CPC ..... *B25G 3/26* (2013.01); *B26B 23/00* (2013.01)

(58) Field of Classification Search
CPC ... B25G 3/26; B26B 23/00; B23P 6/00; Y10T 29/49718; Y10T 29/49721; Y10T 29/49732; Y10T 29/4973; Y10T 29/49739
See application file for complete search history.

(56) References Cited

U.S. PATENT DOCUMENTS 3,090,653 A * 5/1963 Stump ..... B25G 3/34 403/379.5
4,139,930 A * 2/1979 Cox ..... B25D 1/00 81/26
4,281,943 A * 8/1981 Viennot ..... H01B 17/38 264/102
4,404,708 A * 9/1983 Winter ..... B25G 3/28 81/22
5,056,381 A * 10/1991 Carmein ..... B25G 3/34 81/20

* cited by examiner

*Primary Examiner* — Jason L Vaughan
(74) *Attorney, Agent, or Firm* — David W Barman

(57) ABSTRACT

Present invention provided system and method for securing an axe head to an axe handle whereby the system utilizes fastening spring pins to secure the axe head to the axe handle.

1 Claim, 5 Drawing Sheets

REPLACABLE AXE HEAD SYSTEM AND METHOD

BACKGROUND OF THE INVENTION

The market in home heating by wood in many rural locations is becoming more and more affordable. Many of the hard-to-reach mountainous area's use many implements, axes, sledgehammers and hand tools that use wooden handles. A significant problem exists in replacing axe heads. The is the one of reuse of the pins. Typically, the end user must have specific skills in hanging the head in a traditional manner. The current method is to cut the handle off the head, drill out the shimmed area within the eye of the head, fit the handle as closely as possible and then re-shim. This is often a difficult process and one that is not often successful. There is a need for a simple axe head replacement system.

The present invention addresses this need.

SUMMARY OF THE INVENTION

This invention permits the end user to use one handle in multiple heads if the occasion requires it. Assuming that the eye of the tool or head is the same size and configuration. The present invention would have the end user tap out the existing spring pins, tap the handle out of the head refit the handle into the head, drill two holes for the pins in the wood, (using the existing holes in the head don't forget) tap in the two spring pins and the job is complete.

In a simplified manner, the steps of the present mention are:

Remove the spring pins;

Tap the handle out of the head;

Position the head on a new handle;

Using the existing head, drill through the handle using the axe head as a template;

Tap two spring pins into the existing axe handle holes, ensuring the pins are not protruding on either side of the axe head.

The present invention provides for a user to tap out the existing spring pins, tap the handle out of the head, refit the handle into the head, drill two holes for the pins in the wood, (using the existing holes in the head don't forget) tap in the two spring pins and the job is complete. This slight but important change in the use of an axe in this example will benefit the end user for many years.

The present invention provides a significant improvement as it simpler, requires less time and effort to put a new handle on an implement, and provides a more secure axe head on the handle. One reason for these advantages is that conventional wood wedges come loose over time. The spring pins do not come loose.

Spring pins are reusable from old handle to new handle until the pins are damaged in any way.

This invention is primarily a benefit to the purchaser as the replacement of an old handle with a new handle is much quicker and easier. The fact that the axe head, or other implement, has the holes in-place from the supplier means that there is no need to re-do or change the holes for any reason. Also, the spring pins are reusable. The pins are very durable and are not easily bent or damaged. This approach achieves a securement that will not move over time thereby removing the need to continually adjust, replace or add additional shims that are traditionally use by other systems and methods.

In one embodiment, the present invention is an axe handle replacement method, said method comprising the steps of:

providing an axe having an axe head and an axe handle;

removing the axe head from the axe handle;

marking an axe head handle support with indicia for drilling receiving handle fastening pin cavities at a 45 degree angle relative to the perpendicular formed by the axe handle and the edge of the axe head opposite the blade;

positioning the axe head on the axe head handle support; and securing the axe head onto the axe head handle support using one fastening spring pin in each of axe head fastening cavities of said axe head.

In one embodiment, the present invention is an axe handle replacement method, said method consisting of the steps of:

providing an axe having an axe head and an axe handle;

removing the axe head from the axe handle;

marking an axe head handle support with indicia for drilling receiving handle fastening pin cavities at a 45 degree angle relative to the perpendicular formed by the axe handle and the edge of the axe head opposite the blade;

positioning the axe head on the axe head handle support; and securing the axe head onto the axe head handle support using one fastening spring pin in each of axe head fastening cavities of said axe head.

DETAILED DESCRIPTION OF THE INVENTION

Figure 1:
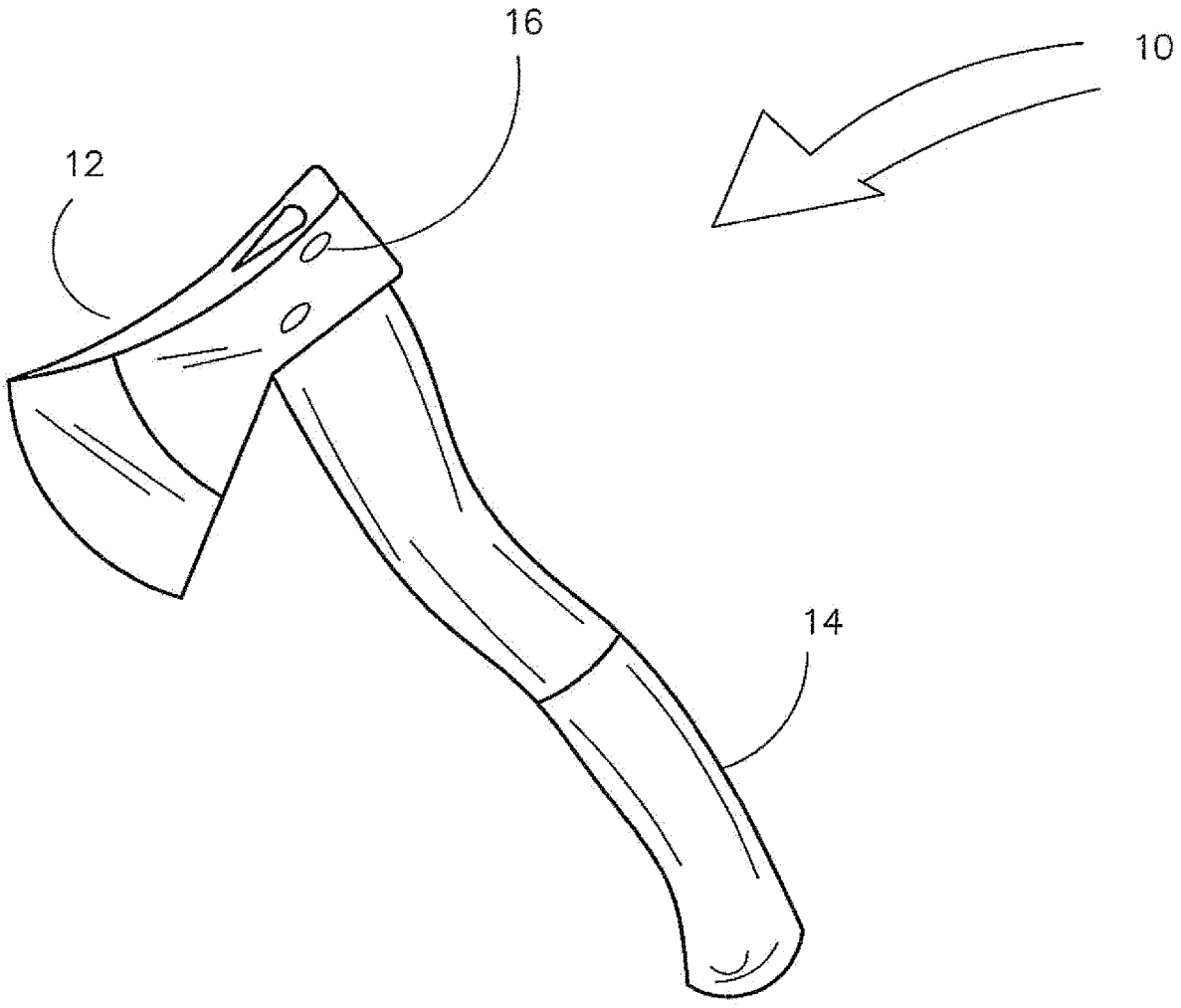
FIG. 1 is side perspective view according to one embodiment of the present invention.
Figure 3:
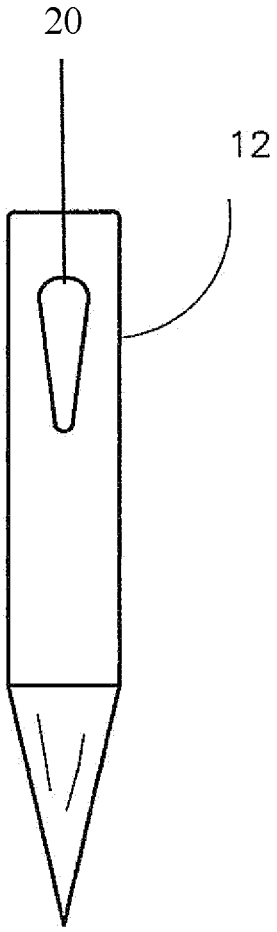
FIG. 3 is top view of an axe head according to one embodiment of the present invention.

As generally understood, System 10 includes an axe head 12 and an axe handle 14. Fastening spring pins 16 are used in existing axe head fastening cavities 18. Axe head 12 further includes handle receiving cavity 20. When axe head 12 is removed, axe head support 22, integral with axe handle 14 is visible.

Figure 2:
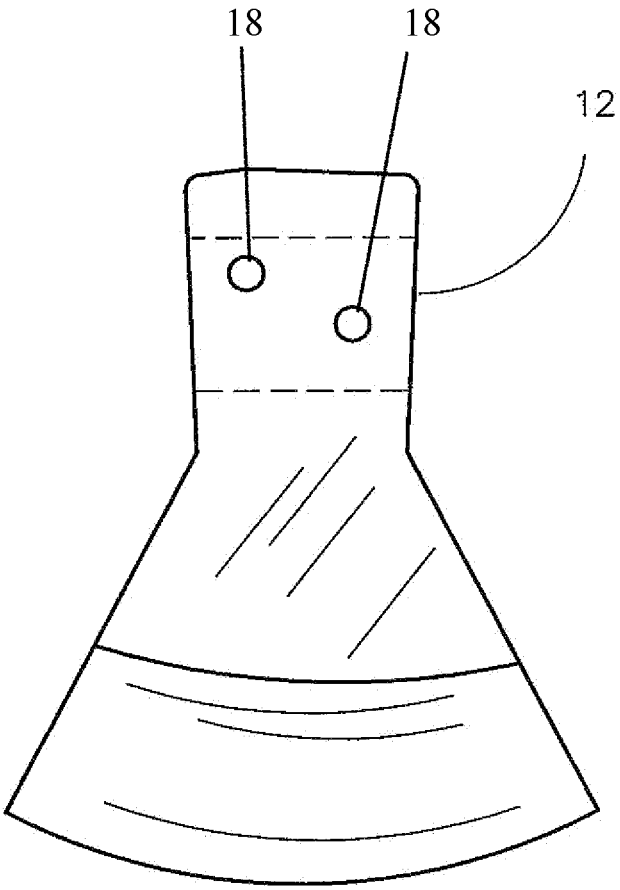
FIG. 2 is side view of an axe head according to one embodiment of the present invention.
Figure 5:
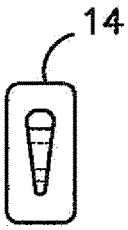
FIG. 5 is top view of an axe head according to one embodiment of the present invention.
Figure 4:
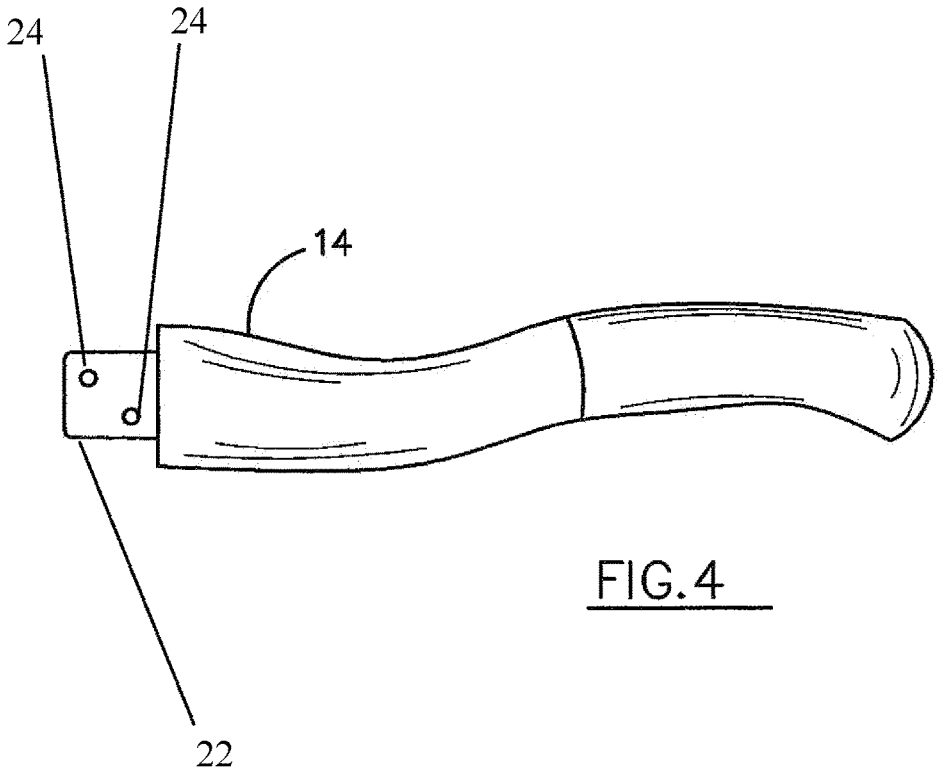
FIG. 4 is side view of an axe handle according to one embodiment of the present invention.
Figure 6:
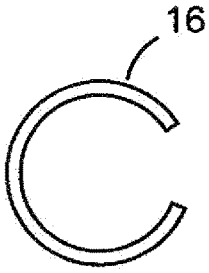
FIG. 6 is end view of a fastening pin according to one embodiment of the present invention.
Figure 7:
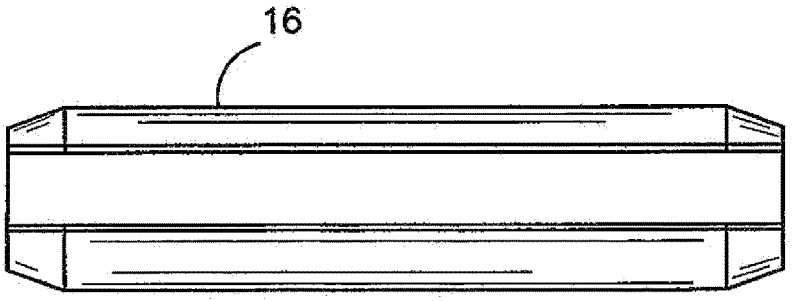
FIG. 7 is side view of a fastening pin according to one embodiment of the present invention.
Figure 8:
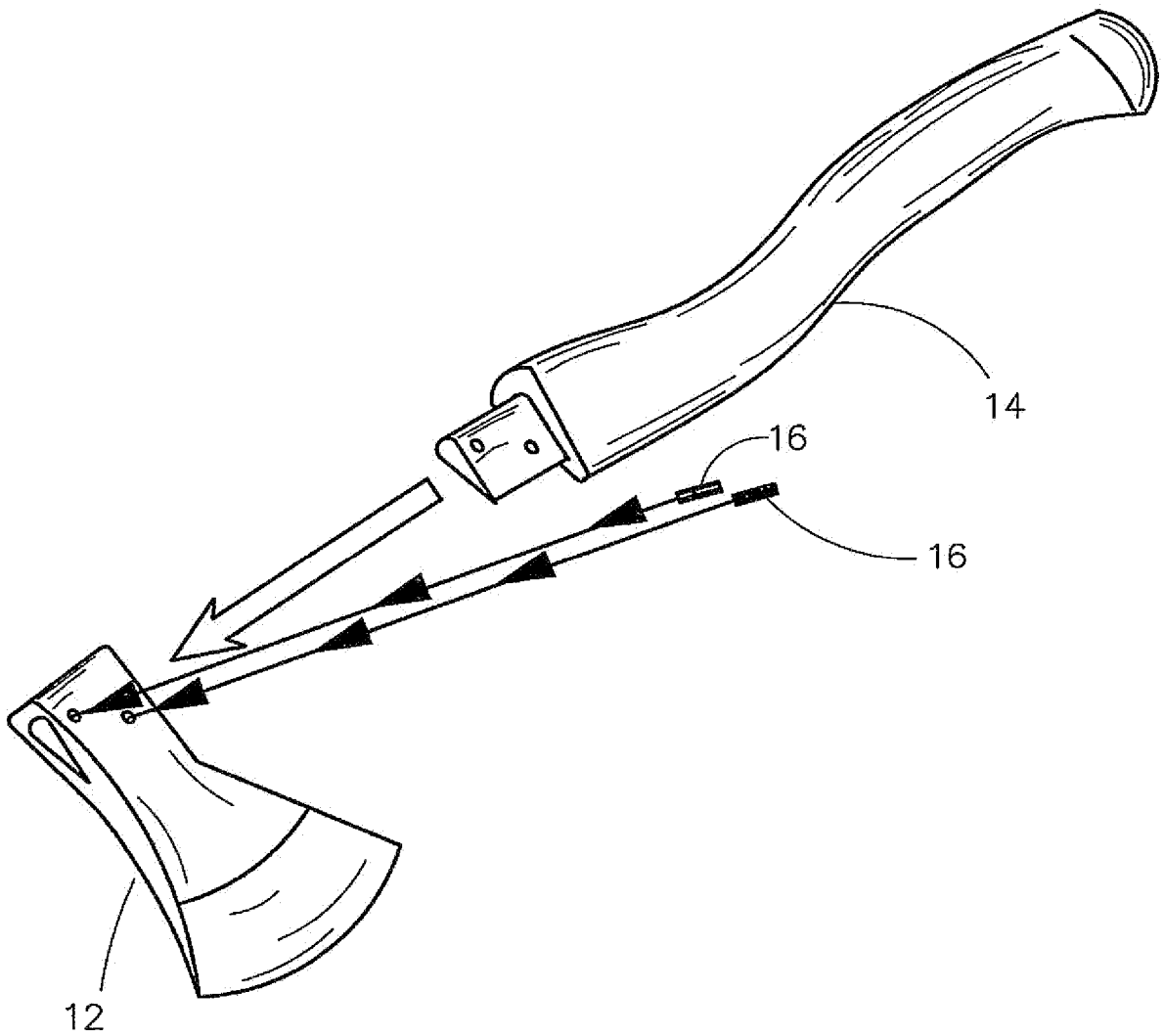
FIG. 8 is an exploded view of the system and method according to one embodiment of the present invention.
Figure 9:
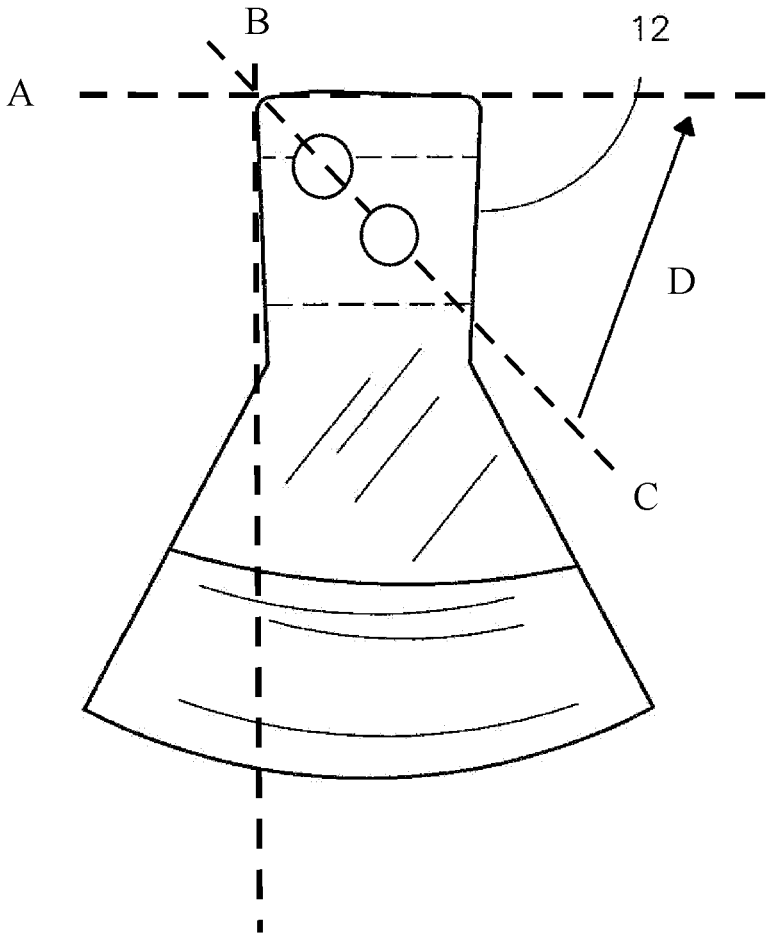
FIG. 9 is a view of the system and method demonstrating 45 degree angle placement of axe head fastening cavities according to one embodiment of the present invention.

With reference to FIG. 9, reference line A represents the plane substantially coplanar with the edge opposite the blade of axe head 12. Reference line B represents the substantially coplanar reference of axe handle 14 when axe head 12 is affixed thereto. Reference line C represents the desired angle for positioning axe head cavities 18 such that reference angle D, formed from line C to line A is 45 degrees. Although FIG. 9 and FIG. 2 differ in appearance as to the 45 degree angle positioning, the figures are not to scale and the skilled artisan is well-aware of the teaching regarding the 45 degree placement of the axe head cavities 18.

When an existing axe head 12 is removed from axe handle 14, axe handle support 22 is visible. In one embodiment, axe handle support 22 is formed of a single unitary piece with axe handle 14. A user will position axe head 12 onto axe handle support 22 and mark the position of axe head fastening cavities 18 on axe handle support 22. Axe head 12 is removed and receiving handle fastening pin cavities 24 are formed in axe handle support 22 using a drill (not shown). Axe head 12 is then positioned onto axe handle support 22 and fastening spring pins 16 are inserted into axe head fastening cavities 18.

Although the invention has been described with reference to specific embodiments and drawings, it is to be understood that the invention is not limited to those precise embodiments, and that various changes and modifications may be affected by one skilled in the art without departing from the scope or spirit of the present invention.

The invention claimed is:

1. An axe handle replacement method, said method comprising the steps of:

providing an axe having an axe head and an axe handle;

removing the axe head from the axe handle;

marking an axe head handle support with indicia for drilling receiving handle fastening pin cavities at a 45 degree angle relative to the perpendicular formed by the axe handle and the edge of the axe head opposite the blade;

positioning the axe head on the axe head handle support; and securing the axe head onto the axe head handle support using one fastening spring pin in each of axe head fastening cavities of said axe head.

* * * * *